US007798343B2

(12) United States Patent
Wang

(10) Patent No.: US 7,798,343 B2
(45) Date of Patent: Sep. 21, 2010

(54) COMBINATION STORAGE RACK

(76) Inventor: Wen-Tsan Wang, 6F., No. 300, Jui Kuang Rd., Taipei City (TW)

( * ) Notice: Subject to any disclaimer, the term of this patent is extended or adjusted under 35 U.S.C. 154(b) by 313 days.

(21) Appl. No.: 11/856,079

(22) Filed: Sep. 17, 2007

(65) Prior Publication Data

US 2009/0071923 A1 Mar. 19, 2009

(51) Int. Cl.
*A47B 43/00* (2006.01)
*A47B 47/00* (2006.01)
*A47B 57/00* (2006.01)

(52) U.S. Cl. ..... 211/187; 211/85.17

(58) Field of Classification Search ..... 312/334.23, 312/246, 330.1; 108/193, 26; 211/85.17, 211/12, 189, 126.15, 187, 162, 85.29, 126.4, 211/133.1; 220/9.1, 9.2, 9.4, 495.08, 495.1; 383/33, 24; 248/95, 99, 100, 101
See application file for complete search history.

(56) References Cited

U.S. PATENT DOCUMENTS 314,752 A * 3/1885 Throckmorton ..... 4/587
2,421,221 A * 5/1947 Rothe ..... 232/30
2,468,897 A * 5/1949 Rothe ..... 383/22
3,179,287 A * 4/1965 Rickmeier, Jr. ..... 220/324
3,563,292 A * 2/1971 Gordon et al. ..... 147/48
4,411,300 A * 10/1983 Rico ..... 383/33
4,921,196 A * 5/1990 Rudko ..... 248/97
5,191,830 A * 3/1993 Jacobson ..... 99/439
5,529,393 A * 6/1996 Polett ..... 383/24
5,531,464 A * 7/1996 Maurer et al. ..... 280/47.35
6,488,243 B2 * 12/2002 Kim ..... 248/100
7,270,245 B2 * 9/2007 Cheng et al. ..... 220/62.1
2002/0105252 A1 * 8/2002 Dorman ..... 312/257.1
2005/0029260 A1 * 2/2005 Sheng-Bin ..... 220/9.1

* cited by examiner

*Primary Examiner*—Darnell M Jayne
*Assistant Examiner*—Stanton L Krycinski
(74) *Attorney, Agent, or Firm*—Leong C. Lei

(57) ABSTRACT

A combination storage rack includes a rack, which has transverse sliding rails symmetrically disposed therein at two sides and arranged in pairs at different elevations, and storage boxes slidably insertable into the rack at different elevations for storing things, each storage box having a top box frame that is a hard rectangular open frame supportable on one pair of transverse sliding rails in the rack and a flexible box body fastened to the top box frame for holding things.

2 Claims, 6 Drawing Sheets

COMBINATION STORAGE RACK

BACKGROUND OF THE INVENTION (a) Technical Field of the Invention

The present invention relates storage racks and more particularly, to an environmentally friendly combination storage rack.

(b) Description of the Prior Art

Regular storage racks for home use generally comprise a rack frame structure and a plurality of storage boxes mounted in the rack frame structure. The rack frame structure may be made of wood or a proper hard or rigid material, defining a plurality of open chambers. The storage boxes are made of wood or a proper hard or rigid material in the form of a solid sliding box for insertion into the open chambers in the rack frame structure.

When a conventional storage rack is damaged, the rack frame structure and the storage boxes cannot be reclaimed for further utilization. Further, the storage boxes of conventional storage racks are not collapsible. When not in use, the user cannot reduce the dimensions of the storage boxes. Further, the storage boxes are not detachable. It is inconvenient to dispose off damaged storage boxes.

SUMMARY OF THE INVENTION

The primary purpose of the present invention is to provide a combination storage rack, which is detachable. It is another object of the present invention to provide a combination storage rack, which is reclaimable when out of service.

To achieve these and other objects and according to one aspect of the present invention, the combination storage rack is comprised of a rack and a plurality of storage boxes. The rack and the storage boxes are made out of environmentally friendly materials. The rack comprises a plurality of transverse sliding rails symmetrically disposed therein at two sides and arranged in pairs at different elevations. The storage boxes are insertable into the rack for storing things. Each storage boxes comprises a top box frame, which is a rectangular open frame supportable on one pair of transverse sliding rails in the rack and comprises a plurality of insertion holes cut through top and bottom edges thereof and spaced along the four sides, a box body, which comprises a plurality of eyelets disposed at the top side and respectively upwardly inserted through the insertion holes of the top box frame, and a plurality of rod members respectively inserted through the eyelets of the box body and supported on the top edge of the top box frame to secure the box body to the top box frame.

According to another aspect of the present invention, the rack comprises two upright side frames arranged in parallel, a horizontal top panel fixedly connected between the upright side frames near the top side, and a horizontal bottom panel fixedly connected between the upright side frames near the bottom side. Further, the transverse sliding rails are respectively affixed to the upright side frames at different elevations between the horizontal top panel and the horizontal bottom panel.

According to still another aspect of the present invention, the storage boxes are made out of a flexible material, each comprising a hard bottom plate set in the associating box body for bearing storage items.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
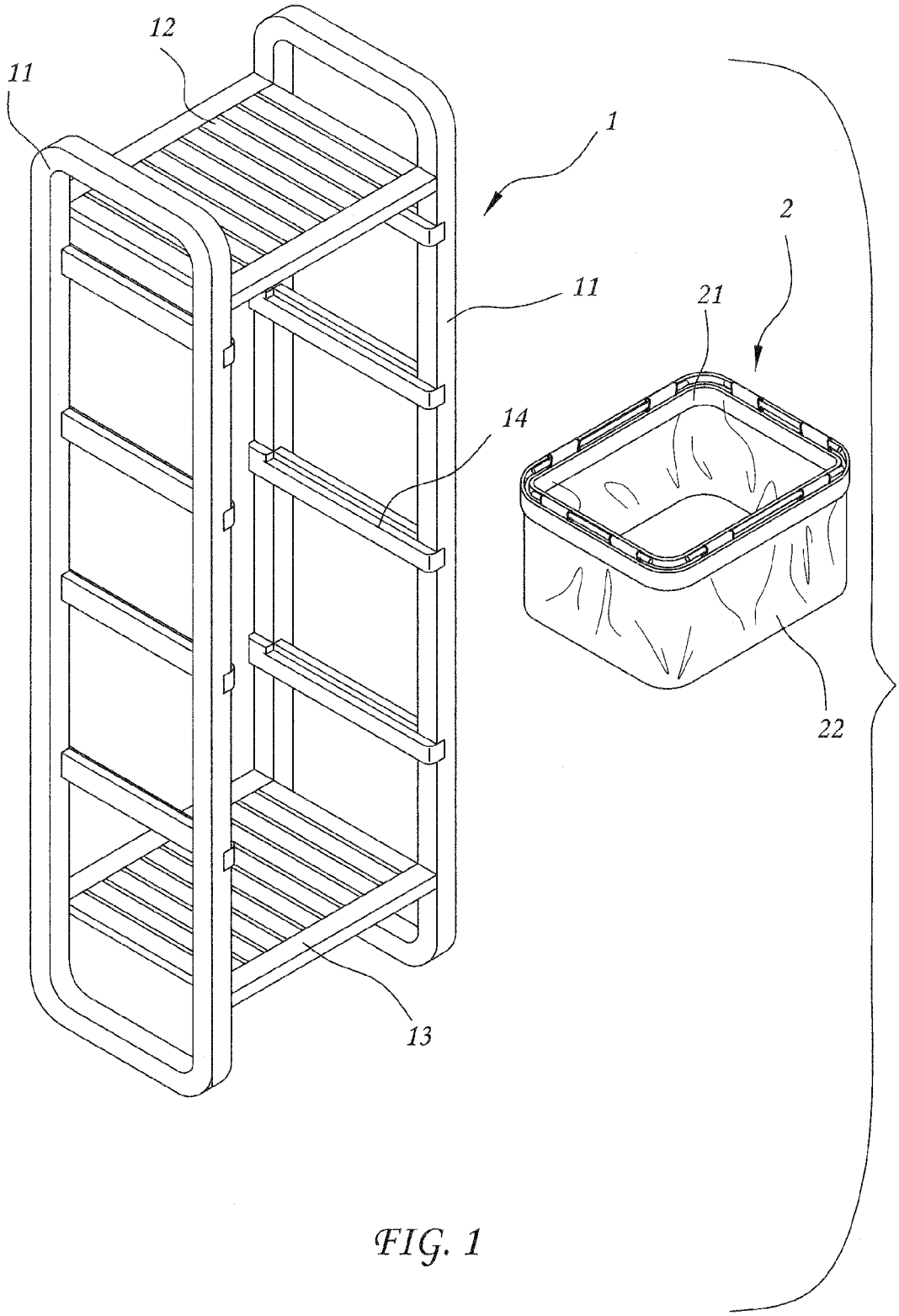
FIG. 1 is an exploded view of a combination storage rack according to the present invention (the shaped decoration item excluded)
Figure 2:
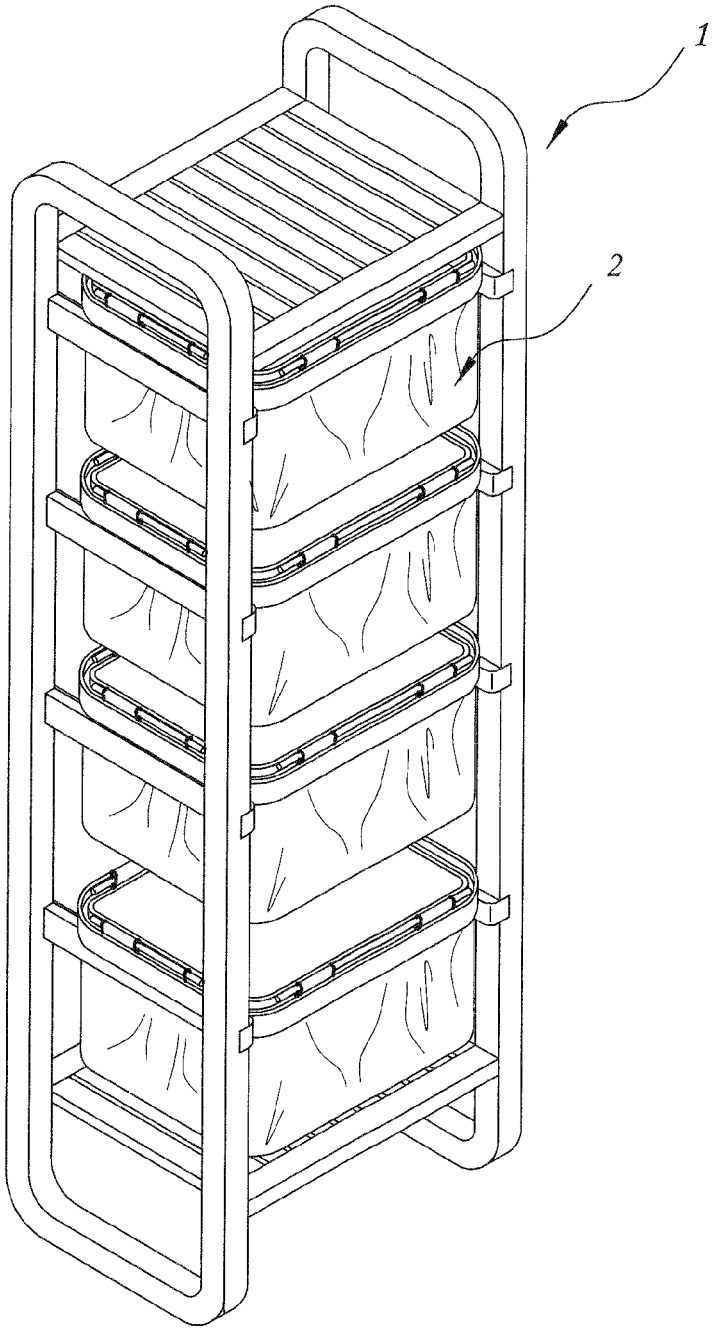
FIG. 2 is an elevational assembly view of the combination storage rack according to the present invention.

Referring to FIGS. 1 and 2, a combination storage rack in accordance with the present invention is shown comprised of a rack 1 and a plurality of storage boxes 2. The rack 1 comprises two upright side frames 11 arranged in parallel, a horizontal top panel 12 and a horizontal bottom panel 13 fixedly connected between the two upright side frames 11 and respectively disposed near the top and bottom sides of the upright side frames 11, and pairs of transverse sliding rails 14 affixed to the upright side frames 11 at different elevations. The transverse sliding rails 14 may be respectively fastened to the upright side frames 11 by means of a tongue and groove joint. The horizontal top panel 12 and the horizontal bottom panel 13 may be affixed to the upright side frames 11 with wood screws. The storage boxes 2 are removably mounted in the rack 1 and supported on the pairs of transverse sliding rails 14. Each storage box 2 comprises a top box frame 21 made out of a hard or rigid material, and a flexible box body 22 made out of fabric or any of a variety of flexible materials and fastened to the top box frame 21. The top box frame 21 is a rectangular open frame slidably coupled to one pair of transverse sliding rails 14 in the rack 1.

Figure 3:
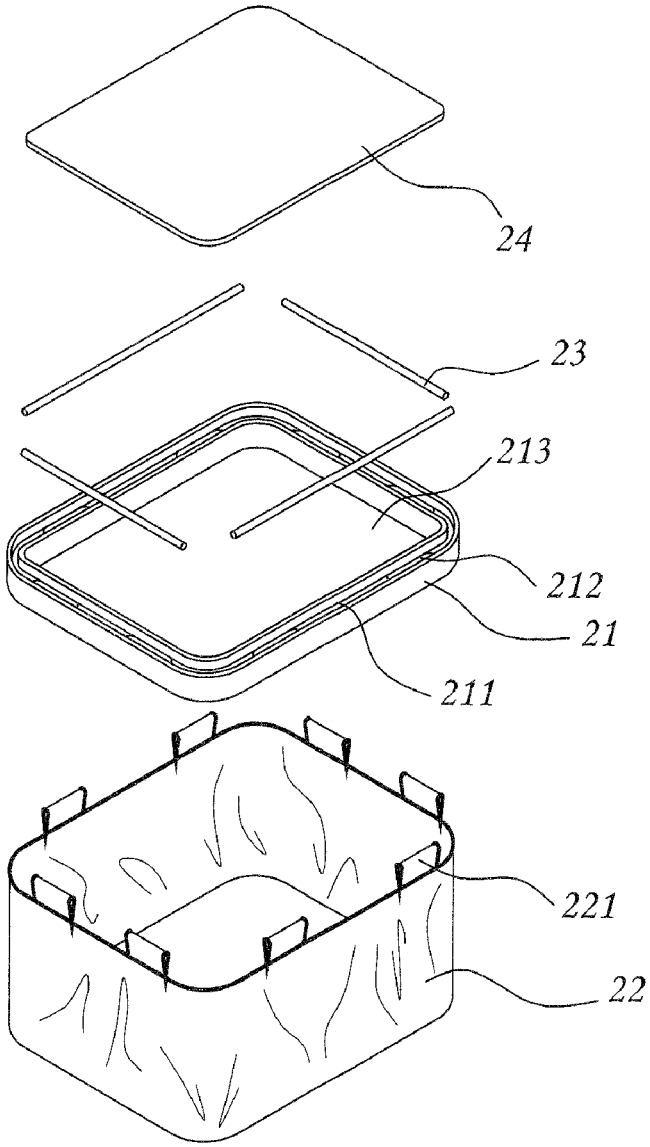
FIG. 3 is an exploded view of one storage box for the combination storage rack according to the present invention.
Figure 4:
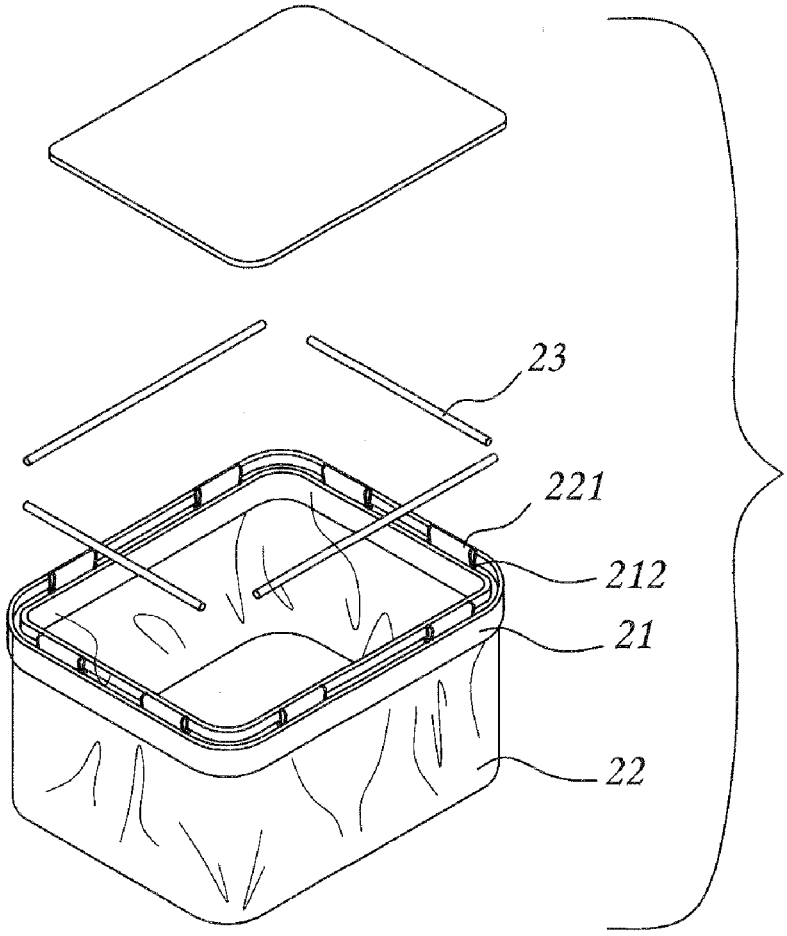
FIG. 4 corresponds to FIG. 3, showing the eyelets of the flexible box body inserted through the respective insertion holes of the top box frame.
Figure 5:
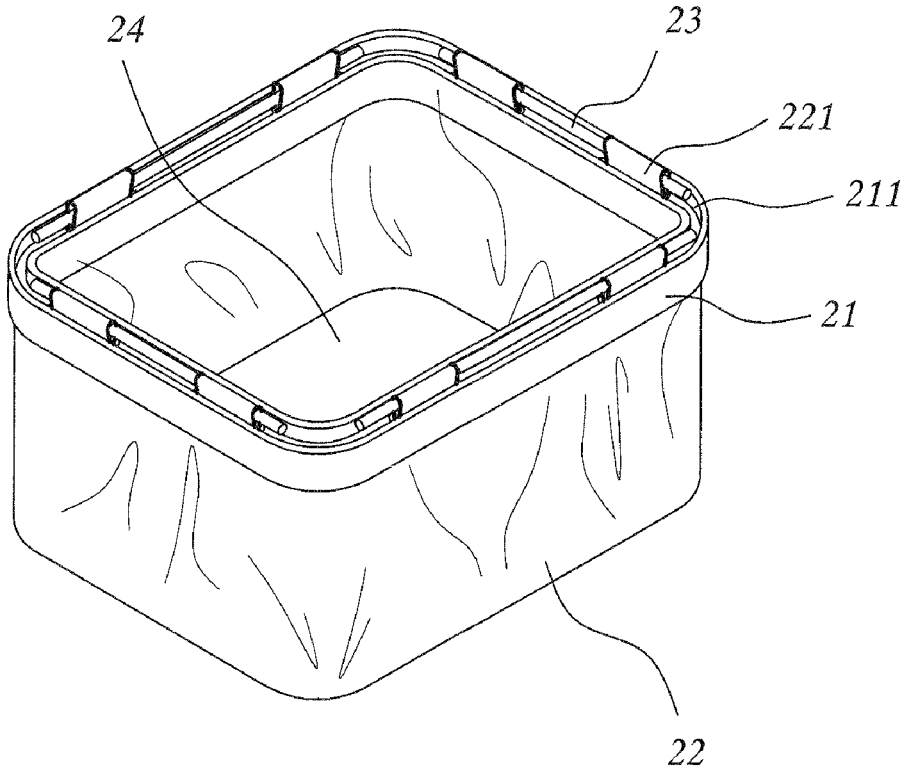
FIG. 5 is an elevational assembly view of one storage box for the combination storage rack according to the present invention.

Referring to FIGS. 3-5 and FIGS. 1 and 2 again, the top box frame 21 of each storage box 2 has an endless top mounting groove 211 extending along the four peripheral sides at the top, and a plurality of vertical insertion holes 212 cut through the top and bottom sides across the endless top mounting groove 211. The flexible box body 22 of each storage box 2 has a plurality of eyelets 221 protruded from the topmost edge around the periphery and respectively inserted through the vertical insertion holes 212 of the top box frame 21. After insertion of the eyelets 221 of the flexible box body 22 of one storage box 2 through the vertical insertion holes 212 of the associating top box frame 21 in direction from the bottom side of the associating top box frame 21 toward its top side, four rod members 23 are respectively inserted through the eyelets 221 of the flexible box body 22 and then set in the endless top mounting groove 211 at four sides, securing the flexible box body 22 to the associating top box frame 21. Each storage box 2 further comprises a bottom plate 24 made out of a hard or rigid material and put in the flexible box body 22 to bear the storage items in the respective storage box 2.

Figure 6:
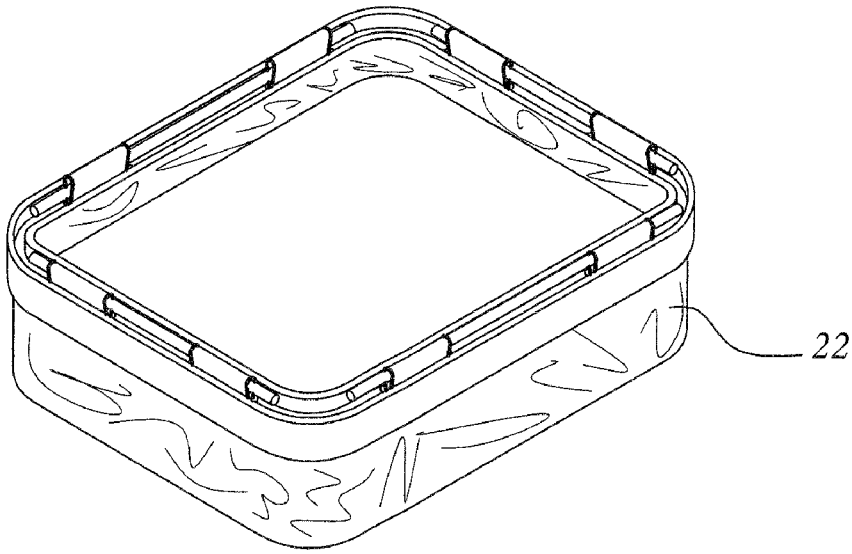
FIG. 6 illustrates a collapsed status of one storage box for the combination storage rack according to the present invention.

Referring to FIG. 6, the flexible box body 22 of each storage box 2 can be folded into a flat manner to reduce the dimension of the respective storage box 2 when the respective storage box 2 in not in use.

Although a particular embodiment of the invention has been described in detail for purposes of illustration, various modifications and enhancements may be made without departing from the spirit and scope of the invention. Accordingly, the invention is not to be limited except as by the appended claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A combination storage rack comprising:

a rack comprising two upright side frames arranged in parallel, a horizontal top panel and a horizontal bottom panel fixedly connected between said two upright side frames and respectively disposed near top and bottom sides of said upright side frames, and a plurality of transverse sliding rails affixed to said upright side frames to form respective pairs of transverse sliding rails at different elevations; and a plurality of storage boxes removably mounted in said rack and supported on said pairs of said transverse sliding rails, each of said storage boxes comprising a top box frame made of a rigid material and a box body secured to said top box frame, said top box frame being a rectangular open frame slidably coupled to one pair of transverse sliding rails in said rack; said top box frame having an endless or continuous top mounting groove extending along four peripheral sides at a top of said top box frame, and a plurality of vertical insertion holes cut through top and bottom sides across said endless top mounting groove, said box body having a plurality of eyelets protruded from a topmost edge around a periphery of said box body and respectively inserted through said vertical insertion holes of said top box frame, four rod members respectively inserted through said eyelets of said box body and set in said endless top mounting groove at four sides thereby securing said box body to said top box frame, and a bottom plate made of rigid material and put in said box body for bearing storage items.

2. The combination storage rack as claimed in claim 1, wherein said box body of each of said storage boxes is respectively made out of a flexible material.

* * * * *